United States Patent [19]

Strong

[11] Patent Number: 4,763,489

[45] Date of Patent: Aug. 16, 1988

[54] MODULAR JEWELRY

[76] Inventor: Llyn Strong, 16 Sunset Dr., Greenville, S.C. 29605

[21] Appl. No.: 876,222

[22] Filed: Jun. 19, 1986

[51] Int. Cl.[4] ..... A44C 5/00

[52] U.S. Cl. ..... 63/4; 63/13; 63/20; 59/80; 24/230.5 W

[58] Field of Search ..... 63/1 R, 1 A, 2, 3, 4, 63/5 R, 28, 12, 13, 14; 59/78, 80, 81, 82; 24/614–616, 573, 230.5 W, 230.5 TP, 265 H, 265 AL, 359; D11/40, 41, 42, 43

[56] References Cited

U.S. PATENT DOCUMENTS

| | | | |
|---|---|---|---|
| 8,300 | 4/1851 | Beals | D11/43 |
| 119,530 | 10/1871 | Northup | 63/13 |
| 621,118 | 3/1899 | Markie | 24/359 |
| 650,817 | 6/1900 | Bradway | 24/359 |
| 758,848 | 9/1903 | Pejchar | D11/41 |
| 816,966 | 4/1906 | Dabney | 24/359 |
| 1,088,549 | 2/1914 | Depollier | 24/265 H |
| 1,090,694 | 3/1914 | Depollier | 24/265 H |
| 1,405,516 | 2/1922 | Humphreys | 24/265 H |
| 1,797,968 | 3/1931 | Sweeney | 59/80 |
| 1,891,056 | 12/1932 | Schoeninger | 59/80 |
| 2,335,944 | 8/1944 | Beggs | 430/531 |
| 2,789,380 | 4/1957 | Philmus | 59/80 |
| 3,071,938 | 1/1963 | Davidson | 63/13 |
| 3,360,923 | 1/1968 | Quisling | 59/78 |
| 3,855,723 | 12/1974 | McGahee | 24/230.5 W |
| 4,221,118 | 9/1980 | Chicckine | 63/13 |
| 4,400,932 | 8/1983 | Epstein | 63/28 |
| 4,406,296 | 9/1983 | Wexler | 63/2 |
| 4,448,017 | 5/1984 | Stark | 59/80 |

*Primary Examiner*—Richard J. Johnson
*Assistant Examiner*—Kevin G. Rooney
*Attorney, Agent, or Firm*—Dority & Manning

[57] ABSTRACT

A plurality of structures, both alike and disalike, selectively and collectively comprising modular jewelry, may be arranged in various configurations as earrings, a pendant, a bracelet, necklace, belt, or the like. Such modular jewelry elements may be engaged and disengaged with one another without any substantial bending or flexing of attachment features thereof, while still providing a substantial freedom of movement for adjacent interconnected modular jewelry elements. Such modular jewelry is both functional and aesthetically acceptable. The disclosed structure shields from view the modularity of the jewelry, while providing modular elements which are readily reconfigured as desired but which do not become readily disassembled when not desired.

16 Claims, 2 Drawing Sheets

MODULAR JEWELRY

BACKGROUND AND SUMMARY OF THE INVENTION

This invention concerns modular jewelry in general, and more particularly jewelry which may comprise a plurality of modular elements having several common characteristics, and which may be selectively reconfigured for a variety of uses.

The manufacture and sale of jewelry constitutes a very large market which cuts across virtually every known consumer and wholesale channel of trade, including: department stores, jewelry specialty shops, wholesale stores, and mail order catalogues. Much of such jewelry is embodied in a fixed configuration which is not intended to be (and likely, literally can not be) altered by a user.

Conventionally, jewelry may comprise various predetermined configurations of metal elements (perhaps of precious or semi-precious metals, or mixtures thereof, or even of other types of alloys) with various jewels or stones (including precious, semi-precious, and man made). The metal elements may be unitarily formed or bent into closed or sealed interconnections such that a change in their relationship is not intended or is not possible. Hence, while such conventional jewelry may constitute jewelry pieces which are highly desireable and useful with a variety of outfits, they are limited in at least the sense that they cannot be altered to accommodate changes in a user's particular desires or needs.

Therefore, the general concept of modular jewelry (i.e. permitting the user to selectively re-configure various pieces) offers substantial advantages which are unparalleled by conventional fixed-configuration jewelry. However, one of the chief appeals and considerations in the selection of jewelry is aesthetically oriented. Even the advantages offered by modular jewelry would be of no moment if the structure and mechanisms by which such modularity were achieved reduced the aesthetic appeal of the jewelry.

Furthermore, even aesthetically-acceptable modular jewelry would still not be commercially successful if it were not suitably functional. For example, it would be a considerable problem if the modular elements became easily disassembled when worn, i.e. at a time when disassembly was not desired. Also, modular jewelry which required substantial bending or flexing of metal pieces or the like to engage and disengage the modular elements would probably experience failure of the attachment mechanism within a short time due to damage caused by such bending.

Another functionality consideration of jewelry is the flexibility of inter-connected elements. For example, bracelets, necklaces and the like in many situations ought to be very flexible pieces. In such instance, it would be undesirable if the modular elements of a given modular jewelry arrangement had fairly rigid interconnection between such elements, instead of permitting a relatively free flow of movement among the modular elements in a manner similar to non-modular bracelets and the like. Also, if attachment mechanisms or the like for various modular elements permitted free movement among adjacent mcdular elements but presented sharp edges extended significantly out from the body of the jewelry, considerable damage could be caused to expensive clothing, or even an injury could occur to a user of the jewelry, or someone coming in contact therewith.

The concept of modular jewelry is generally known in the prior art, as represented by the following exemplary U.S. patents (listed in the order of their following discussion):

| U.S. PAT. NO. | INVENTOR(S) | DATE ISSUED |
|---|---|---|
| 2,355,944 | Beggs | August, 1944 |
| 1,797,968 | Sweeney | March, 1931 |
| 1,891,056 | Schoeninger | December, 1932 |
| 4,448,017 | Stark | May, 1984 |
| 2,789,380 | Philmus | April, 1957 |
| 3,360,923 | Quisling | January, 1968 |
| 4,221,118 | Chicckine | September, 1980 |
| 3,071,938 | Davidson | January, 1963 |

Beggs discloses an ornamental chain comprising modular elements which may be removably interlocked with one another without requiring any substantial bending or deforming operation on individual elements. Heart-shaped members comprise a head or tongue connected by a neck for insertion into and engagement with a bent-end portion of an adjacent link. The all metal construction utilizes a central portion of modular elements to interconnect same, instead of receiving jewel stones or the like. The Beggs modular elements may be disassembled by relative movement on the order of only 50° out of parallel alignment with one another, as illustrated by Beggs FIG. 5.

Sweeney teaches detachably connectable members shaped like butterflies, which may be formed into various combinations as a neck band, necklace, belt, or the like. Antennae of the modular butterfly must be substantially bent or flexed so that paired knob ends thereof project through common openings on the body of adjacent modular butterfly pieces.

Schoeninger discloses an ornamental chain construction whereby modular links may be selectively engaged and disengaged by bending about 90° an extended member of the modular element once same is disposed so as to pass through an opening in an adjacent modular member. Stark similarly discloses a method of assembling a jewelry chain whereby segments of links formed from flattened rings are crimped so as to secure one link to an adjacent link. There is no apparent concern for subsequent removal of such links to permit re-configuration thereof. Philmus and Quisling disclose various jewelry construction techniques whereby modular elements are joined to one another through bending, crimping, or similar steps.

Chicckine and Davidson both concern pierced earring arrangements having pierced ear elements which utilize a hook construction for holding a loop associated with a separate hanging element. No particular modular jewelry construction is disclosed. Both such references disclose enlarged end elements on their hook members for securely engaging the members hanging therefrom, instead of providing any modularity such as ready removal of the hanging members from such hocks.

The present invention possesses advantages not taught or suggested by such exemplary prior U.S. patents, and otherwise recognizes and addresses concerns for modular jewelry, in general.

For example, it is an object of the present invention to provide modular jewelry which is aesthetically pleasing, while not being readily apparent that such jewelry is modular.

It is a further object of this invention to maximize the modularity affect thereof by providing modular jewelry which may be re-configured into one of a plurality of different types of jewelry, including such as earrings, a pendant, a pin, a bracelet, a necklace, or a belt. Furthermore, it is an object of the present invention that within such various configurations comprising different types of jewelry, alternate orientations may be obtained, including the use of different numbers of modular elements, modular elements of different sizes or shapes but possessing certain minimum common characteristics, or modular elements having various different stone settings or the like.

It is a further object of the present invention to provide modular jewelry which is not only aesthetically pleasing, but which is also functionally acceptable. For instance, modular jewelry in accordance with the present invention provides substantial relative freedom of movement among adjacent modular elements when such modular elements are interconnected. However, it is a further object of this invention that selective engagement and disengagement of the modular elements may be provided so as to achieve the desired freedom of movement without becoming undesirably disassembled, while also providing attachment means which may be engaged and disengaged without the necessity of any bending, or at least no substantial bending, of such attachment means. Such objects collectively contribute to the advantageous functional features of the present invention since lack of bending and flexing for attachment elements prolongs the useful life of the modular jewelry.

It is a further object of this invention that all of the foregoing functional advantages be achieved without requiring attachment structure which has any sharp edges or which projects significantly beyond the main body of such jewelry such that there is risk of damage to clothing or injury to wearers. In one instance, such object is contributed to by use of a hook attachment mechanism which has the end thereof shielded by its placement near the back center of a jewelry piece.

Various combinations of the features of the present invention which achieve the foregoing stated objects and others may be embodied in a given construction to comprise modular jewelry in accordance with the present invention.

For example, in one embodiment in accordance with the present invention, an apparatus is provided for modular jewelry including a plurality of modular elements, the elements comprising: a main member providing a first opening adapted for receipt and securement of a jewelry piece by an interference fit in the first opening; an eyelet integrally associated with a given side of the main member; and a capture hook integrally associated with an opposite side of the main member from the eyelet, and defining an enlarged capture area for removable receipt and capture of an eyelet associated with an adjacent modular element, and further defining a restricted capture path leading to the enlarged capture area; wherein an eyelet captured in such an enlarged capture area has substantial freedom of movement relative the modular element with which such capture area is associated.

In yet another construction in accordance with teachings of the present invention, modular jewelry apparatus comprises a plurality of modular elements, each modular element having: means for retaining jewel stones; eyelet means for removable connection of its respective modular element to adjacent modular elements; and attachment means for removably attaching thereto eyelet means of an adjacent modular element so as to attach adjacent modular elements to one another, without requiring any substantial bending of said attachment means, and for providing substantial freedom of relative movement between adjacent modular elements so attached.

In still another exemplary oonstruction in accordance with features of the present invention, modular jewelry is provided, comprising: a plurality of jewel-receiving members, each including at least one of matable hook means and eyelet means for removably connecting the members to one another without requiring any substantial bending of either the hook means or the eyelet means, and for establishing an inter-connection providing up to 90° of movement between adjacent members in at least two planes intersecting where such members are inter-connected.

The foregoing objects and features of the present invention, as well as numerous other objects and features thereof may be better understood upon a complete study of the following description.

BRIEF DESCRIPTION OF THE DRAWINGS

The following description provides an enabling disclosure of the present invention to one of ordinary skill in the art, including present exemplary preferred embodiments thereof, as well as a best mode thereof. Such description may be more fully understood when studied in conjunction with the appended figures, in which.

Use of like reference characters in the various figures is intended to indicate like or analogous elements or features of the present invention.

DETAILED DESCRIPTION OF THE PREFERRED EMBODIMENTS

Figure 1:
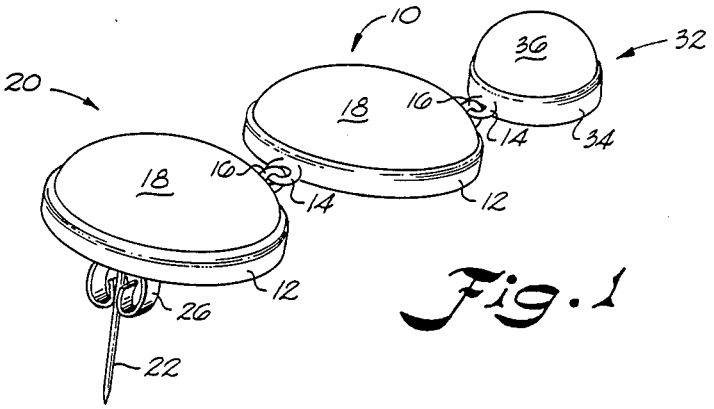
FIGS. 1 and 2 illustrate front and back perspective views, respectively, of modular jewelry in accordance with this invention in an earring configuration.
Figure 2:
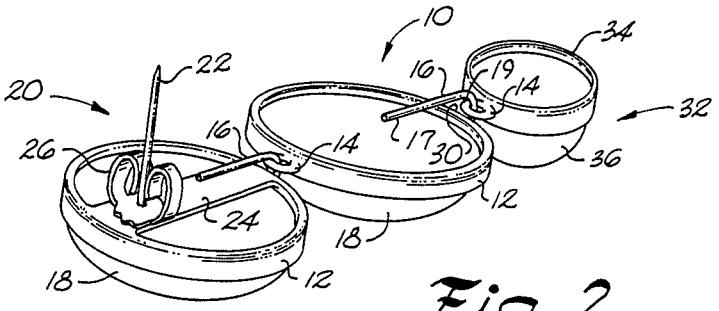

FIGS. 1 and 2 illustrate front and back perspective views, respectively, of three modular elements in accordance with this invention, all three having slight variations one from another, but some commonality as well. Modular element 10 is the basic modular element in accordance with this invention, and includes a main member 12, an eyelet means 14 on one peripheral side thereof, and a capture hook 16 on a peripheral side opposite eyelet means 14. A solid stone or jewel member 18 is received in a central or first opening defined by main member 12. As illustrated in the FIG. 1 frontal view, stone 18 may typically be projected outward from main member 12 on the front side thereof, while as illustrated in the FIG. 2 back view, stone 18 is recessed from the back side of main member 12. Such arrangement provides maximum aesthetic appeal for the frontal view, while providing functionality for the back, as discussed below in greater detail.

Main member 12 of modular element 10 may comprise an oval shape (as illustrated), a round shape, or virtually any other geometric or non-geometric configuration. Moreover, stone 18 may comprise virtually any kind of precious, semi-precious, or artificial stone or jewel. Alternatively, so-called stone 18 could incorporate metals, used alone or in combination with different stones or jewels. The specific configuration and composition illustrated is intended as exemplary and not limitive. Furthermore, a variety of techniques may be utilized to receive and secure stone 18 within the central opening of main member 12. An interference fit is preferred, but adhesive materials or the like may be used.

Main member 12, as well as eyelet 14 and hook 16 preferably comprise some form of precious or semiprecious metals, and are integrally formed with one another. The overall physical size of modular element 10 may vary in accordance with the specific desires or needs of one practicing the present invention, but a metal wire diameter size of about 0.1 centimeters is typically preferred for the wire comprising eyelet 14 and hook 16. Such measurement is intended as an approximation of a preferred embodiment, and variations therefrom are also included features of the present invention.

Modular element 20 comprises a variation of modular element 10, which is basically adapted for use in an earring configuration of the present invention. Eyelet 14 is reconfigured as an earring post piece 22, associated with a bracing member 24 formed integrally with main member 12 as illustrated along the bottom of jewel piece 18. Jewel piece 18 may again be secured to main member 12, and as illustrated in the frontal perspective of FIG. 1, the cross-member 24 and the post piece 22 are blocked from view by such stone 18. Hence, a pleasing aesthetic appearance is maintained for the frontal view of the modular elements in accordance with the present invention.

Typically, modular element 20 may further include a clasp element 26 for mated operative association with earring post piece 22. Of course, operative equivalents of post piece 22 and clasp 26 may be used; for example, the earring module may be adapted with a large clasp in place of elements 22 and 26 as an earring for non-pierced ears instead of pierced ears. Furthermore, modular elements 20 may still include a capture hook 16 for operative interconnection with an eyelet 14 associated with an adjacent modular element, such as element 10 of FIGS. 1 and 2.

As illustrated particularly in FIG. 2, capture hook 16 has a straight member 17 which is relatively long compared to the diameter of the wire comprising hook 16. In one preferred embodiment where the wire of hook 16 has a diameter of about 0.1 centimeters, straight member 17 could be up to ten times larger, or about 1.0 centimeters. Furthermore, hook 16 has a curved portion 19 defining on the inner-curvature thereof a capture area which is several times larger (up to three times in one preferred embodiment) than the diameter of the wire comprising hook 16, as well as eyelet 14.

The relative distance between straight member 17 at its closest point passing adjacent main member 12 defines a restriction point 30 which has a displacement between members 12 and 17 about the same size or only very slightly larger than the diameter of the wire comprising eyelet 14. Such arrangement provides a considerable degree of freedom of movement for an eyelet 14 captured within the curvature of curved area 19 of hook 16, while remaining captured therein, at least in part due to the functional relationship of restriction point 30 thereto. Also, with such configuration, upon proper maneuvering eyelet 14 may be removed from the capture area of curved area 19 and restriction point 30 without requiring any substantial bending of any such features. Even if restriction point 30 were reduced to one half of the diameter of the wire of eyelet 14 to provide a detent or "click" when engaging and disengaging adjacent modular elements, hook 16 would have to be bent only 0.05 centimeters to permit eyelet 14 to pass, which is not considered a substantial amount.

Straight member 17 essentially extends parallel to and along the back side of main body 12 and the back side of stone 18, thereby defining a restricted capture path between straight member 17 and such backs for an eyelet 14 leading to the capture area within the curvature of hook curve 19. Such arrangement, along with the enlarged capture area defined by curvature of curve 19, as well as the restriction point 30, all contribute individually and collectively to achieving the object of the present invention that modular elements be interconnected such that they are not accidentally disassembled, but still be provided with relatively substantial freedom of movement relative the interconnected modular elements. Such arrangements and the advantages flowing therefrom are discussed in greater detail below.

Again referring to FIGS. 1 and 2, a modular end piece or element 32 includes a circular main member 34 capturing a stone element 36, and having an integrally associated eyelet member 14, which receives and is captured within a capture hook 16 of an adjacent basic modular element 10. Such end element 32 need not have any form of a capture hook or attachment means other than eyelet 14, since it is not intended that further modular elements be secured thereto.

In the earring configuration of FIGS. 1 and 2, end element 32 comprises a drop piece disposed in vertical orientation hanging from a capture hook 16. While no further elements are intended to be secured to end piece 32, it should be apparent from the foregoing disclosure that additional modular elements 10 may be interposed between the modular element 10 and end element 32 illustrated adjacent to one another in FIGS. 1 and 2. In such manner, a desired length of earrings may be achieved. To obtain such configuration, end element 32 could be simply removed by repositioning same so that eyelet 14 associated therewith may be moved beyond restriction point 30 along the restricted capture path defined between straight member 17 and main member 12 (along with stone 18) of basic modular element 10. Then eyelets 14 of additional modular elements 10 may be placed in series along capture hooks 16 until it is once again desired to terminate the earring with a modular end element 32. Of course, modular elements 10 could be entirely omitted, and end element 32 used alone directly with modular element 20, or element 20 could be used alone or in combination with a singularity or plurality of modular elements 10.

All of the foregoing re-configurations of the structural elements provided in accordance with the present invention further contribute to accomplishment of the aesthetic and functional objects stated above. For example, when viewed from the frontal side, all such configurations shield from view any features which would tend to suggest to the viewer that the piece of jewelry was modular jewelry. However, all such configurations possess the functional advantages discussed above; for example, engagement/disengagement of adjacent modular elements with no substantial bending of any attachment features, while securely providing inter-connections providing substantial relative freedom of movement between adjacent interconnected modular elements.

Figure 3:
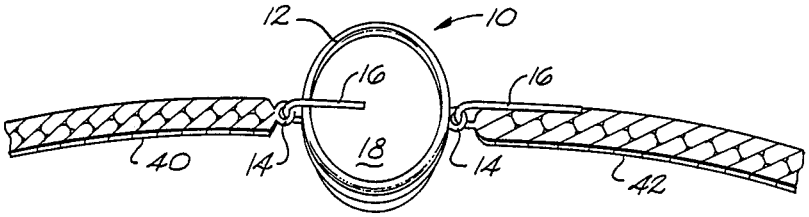
FIG. 3 illustrates a modular jewelry element associated with a modular end element such as a pair of bracelet ends, in accordance with the present invention.

FIG. 3 illustrates another configuration of modular elements in accordance with features of the present invention, wherein a basic modular element 10 is associated with an alternative modular end piece comprising a pair of pieces 40 and 42. Such end pieces 40 and 42 may be provided in varying lengths and sizes so as to comprise bracelet end pieces, necklace end pieces, or even belt end pieces. Ends of end elements 40 and 42 which are not illustrated by FIG. 3 may have matable clasp arrangements for joining one another to complete the bracelet, necklace, or belt arrangement. Alternatively, elements 40 and 42 may integrally join instead of being separably joinable.

End element 40 has no capture hook but instead has an integral eyelet 14, while modular end element 42 has no eyelet but instead a capture hook 16. The respective eyelet and hook of end pieces 40 and 42 are operably associated with the corresponding mating elements, i.e. capture hook 16 and eyelet 14, of basic modular element 10.

FIG. 3 illustrates a back perspective view of such an arrangement; hence, stone 18 is shown as being slightly recessed behind the back of main member 12. Furthermore, as is apparent from the illustration of FIG. 3 itself, capture hooks 16, both that of basic modular element 10 and modular end piece 42, are directed to the back of the arrangement. Hence, the aesthetic appeal of the frontal view of the FIG. 3 configuration is again preserved. At the same time, the relative lengthy straight member, restriction point, and restricted capture path features of the embodiment of FIGS. 1 and 2 are retained so that the FIG. 3 embodiment receives the advantages flowing therefrom, as discussed above.

In brief summary, modular elements 40, 10, and 42 of FIG. 3 have a relatively high degree of freedom of movement between adjacent elements, without such elements becoming undesirably disassembled. However, assembly and disassembly of such modular elements may still be selectively accomplished without any substantial bending or flexing of capture hook 16.

Figure 4:
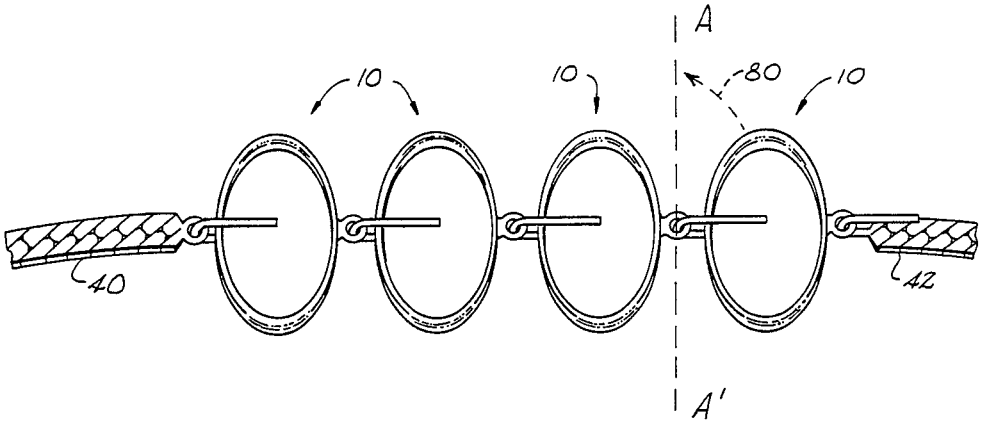
FIG. 4 illustrates a plurality of inter-connected modular jewelry elements in a chain in accordance with the present invention, with a dotted line A-A′ representing a plane running through one such inter-connection and further illustrating the ends of such chain connected to modular end elements comprising a pair of bracelet or necklace end pieces, further in accordance with this invention.

FIG. 4 illustrates a back perspective view of a configuration similar to that of FIG. 3, but with additional basic modular elements 10 interconnected in series between end elements 40 and 42. The interconnection of the eyelets and capture hooks of the FIG. 4 configuration need not be discussed in detail since their operation and inter-relationship is substantially the same as those eyelets and capture hooks discussed above. However, an imaginary plane A-A' is illustrated as intersecting a given interconnection between adjacent modular elements 10. It is readily apparent from the illustration of FIG. 4 that the modular elements 10 on either side of the plane A-A' (like all other pairs of adjacent modular elements) have a considerable degree of freedom of movement relative one another. Such relative movement may extend even up to 90° movement relative plane A-A' along the line of direction shown by arrow 80, without causing disassembly of the inter-connected adjacent modular elements. Such degree of movement is sufficient to provide virtually any desired movement or action of the FIG. 4 configuration.

Figure 7:
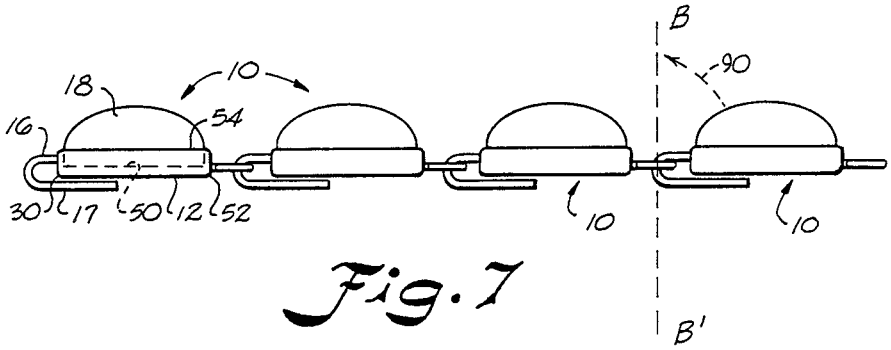
FIG. 7 illustrates a side perspective view of inter-connected modular elements formed as a chain in accordance with the present invention, with one dotted-line representation illustrating how jewelry pieces or jewel stones may be received by a main member of the present modular elements such that the jewelry piece or stone is recessed from the back of such main member, and another dotted-line B-B′ representing a plane intersecting an exemplary inter-connection of such elements.

Referring now to FIG. 7, a side view of the modular elements of the FIG. 4 illustration is shown, with an additional planar line B-B' shown intersecting the interconnection point highlighted by planar line A' in FIG. 4. Such planar line again illustrates, taken in conjunction with the remainder of the illustration of FIG. 7, that adjacent to modular elements 10 may move relative one another up to 90° along the line of direction shown by arrow 90 with respect to such planar line, while remaining interconnected. The illustration of FIG. 7 has removed therefrom modular end elements 40 and 42 for clarity in presenting the illustration.

FIG. 7 further illustrates the projection and recessed features associated with capture and retention of a stone 18 in a main member 12 of a modular element 10. Dotted line 50 illustrates the recessed depth of stone 18 as it is received, typically by an interference fit, in the central opening defined by main member 12. In such instance, back 50 of stone 18 is recessed from a back surface 52 of main member 12, but projected above an upper surface 54 thereof.

Furthermore, FIG. 7 illustrates one modification of the capture hook feature of the present invention, wherein the straight member 17 of hook 16 is brought sufficiently close to the bottom of main member 12 at restriction point 30 that hook 16 must flex slightly to permit an eyelet 14 to pass through the restriction point 30. The amount of movement required may be provided to be very slight, on the order of 0.05 centimeters (as discussed above). Hook 16 need flex only as eyelet 14 passes restriction point 30 because recessed bottom 50 of stone 18 permits eyelet 14 to otherwise traverse the restricted capture path defined between straight member 17 and main member 12 (along with bottom 50 of stone 18) without flexure of hook 16.

Figure 5:
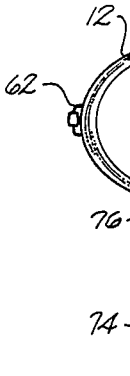
FIGS. 5 and 6 illustrate front and back, respectively, perspective views of modular jewelry in accordance with this invention adapted to be worn on clothing as a pendant, with a modular end piece attached thereto defining a drop piece.
Figure 6:
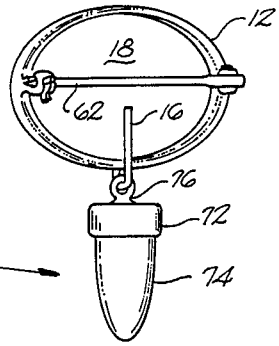

FIGS. 5 and 6 illustrate front and back perspective views, respectively, of a pendant configuration of modular jewelry elements in accordance with features of the present invention. A modular element 60 is illustrated as having a main member 12 and capture hook 16. A stone 18 may again be received in a central opening of main member 12. In lieu of an eyelet 14, modular element 60 has a hinged pin clasp 62 to serve as auxiliary attachment means for pinning modular element 60 onto the clothing of a user. Pin clasp 62 is termed an auxiliary attachment means by way of reference to the fact that it is not intended to serve as an attachment means 16 for attaching its associated modular element to an adjacent modular element. Instead, auxiliary attachment means 62 is for attaching its associated modular element to the clothing or otherwise of the user of the jewelry. Earring post piece 22 and clasp 26 of the FIGS. 1 and 2 embodiment may similarly be referred to as auxiliary attachment means.

FIGS. 5 and 6 also illustrate an alternative modular end piece 70, comprising a drop piece having its own associated main member 72 which receives and holds jewelry stones or pieces 74, while also having integral therewith eyelet member 76 for being selectively attached to modular element 60 by virtue of its associated (main or primary) attachment means provided as capture hook 16. Such configuration again achieves the aesthetic and functional objects and aspects of the present invention; for example, FIG. 5 illustrates the frontal view which hides the modularity aspect of this embodiment of the invention behind stone 18. Of course, additional modular elements 10 may be interspersed in series as desired between modular elements 60 and 70 of the pendant configuration of FIGS. 5 and 6. Also, any of the modular end pieces (such as drop piece 70 or end piece 32) could be utilized directly with any standard stud earing, with the eyelet member thereof captured by the post of such stud earing.

Numerous modifications and variations to the features of the invention as discussed above, including all equivalents and analogous structures and features which would occur to one of ordinary skill in the art, are intended to fall within the scope of the present invention. For example, alternative configurations of the main member 12, including different shapes thereof, or different ways of securing jewelry stones thereto, or providing attachment means therefor, either main or auxiliary, are included within the description of such main member by virtue of present reference thereto.

Furthermore, any various combination or selection of presently disclosed features of the present invention set forth in a given embodiment or construction of modular jewelry is included as an embodiment of this invention. Also, the detailed description of the presently preferred embodiments discussed above is intended as words of description only, and not words of limitation, which appear only in the following claims.

What is claimed is:

1. An apparatus for modular jewelry including a plurality of modular elements, said elements comprising:

a main annular member, having respective top and bottom edges, and providing a first opening adapted for receipt and securement of a jewelry piece by an interference fit in said first opening, such jewelry piece directed within said main annular member first opening;

an eyelet integrally associated with an outside peripheral surface of said main annular member; and a capture hook integrally associated with a diametrically opposite peripheral surface of said main annular member from said eyelet, and defining an enlarged capture area relatively adjacent the base of said capture hook for removable receipt and capture of an eyelet associated with an adjacent modular element without bending of said capture hook or such eyelet, and further defining a capture path generally along the length of said capture hook leading to said enlarged capture area thereof and along which an eyelet may be freely advanced towards said capture area, said capture path having an entrance thereto disposed inwardly of said main annular member bottom edge and adjacent said jewelry piece bottom side and freely accessible by an eyelet for traveling along said path, said path further including a relatively narrow tolerance restriction point therealong formed adjacent said enlarged capture area by said capture hook base and said main annular member bottom edge;

wherein an eyelet may be captured in said enlarged capture area in conjunction with said restriction point adjacent thereto so as to have substantial freedom of movement relative the modular element with which such capture area is associated, and with improved ease in engaging such eyelet with said capture path entrance and advancing same along such path down to said restriction point thereof, without view of said capture path entrance from said jewelry piece top side.

2. An apparatus as in claim 1, wherein:

said eyelet and said capture hook are formed from uniform size metal wire of the same diameter;

said capture path comprises a distance approximately ten times longer than the diameter of said metal wire, and said path restriction point is approximately at least the same size as such diameter; and at least one dimension of said capture area is approximately three times larger than said diameter of said metal wire.

3. An apparatus as in claim 2, wherein said metal wire diameter is about 0.1 centimeters.

4. An apparatus as in claim 1, wherein at least one of said modular elements further includes auxiliary attachment means separate from said capture hook and said eyelet.

5. An apparatus as in claim 4, wherein said auxiliary attachment means comprise an earring post piece and mating clasp, whereby said apparatus is adapted to be worn as pierced earrings.

6. An apparatus as in claim 4, wherein said auxiliary attachment means comprise a hinged pin clasp, whereby said apparatus is adapted to be worn on clothing as a pendant.

7. An apparatus as in claim 1, further comprising at least one modular end piece having a main body piece receiving jewelry pieces, and having one of an eyelet and a capture hook, for selected matable association with corresponding eyelets and capture hooks of said modular elements.

8. An apparatus as in claim 7, wherein said modular end piece comprises either of:

a drop piece having a main body member for receipt of a jewelry piece, and having an eyelet adapted for hanging said drop piece in a vertical orientation from a capture hook of a modular element; and a pair of bracelet, necklace, or belt pieces, one each having an eyelet and a capture hook, respectively, for corresponding operative association with a capture hook and an eyelet of said modular elements to define such bracelet, necklace, or belt.

9. Modular jewelry apparatus comprising a plurality of modular elements, each modular element having an annular member with top and bottom edges generally and:

means for retaining jewel stones in said annular members primarily facing said top edges thereof;

eyelet means for removable connection of its respective modular element to adjacent modular elements; and attachment means, integrally associated with an outside peripheral surface of said modular element annular member for removably attaching thereto eyelet means of an adjacent modular element so as to attach adjacent modular elements to one another, without requiring bending of said attachment means or of said eyelet means, and while permitting relative movement between adjacent modular elements so attached; and wherein said eyelet means comprises a metal ring with a central opening, integrally associated with an outside peripheral surface of said modular element annular member generally diametrically opposite that from attachment means of such modular element and having a predetermined diameter for the metal comprising such ring; and said attachment means comprises a metal hook having a straight member, substantially longer than the diameter for said metal, and disposed generally along and relatively near said jewel stone bottom side so as to define a restriced capture path of said eyelet means along said bottom side with said straight member received in said metal ring central opening, with an entrance to said capture path defined inwardly of said annular member bottom edge and adjacent said jewel stone bottom side, and said hook further having a curved area joining said straight member to said modular element, and defining a generally enlarged capture area for receipt and securement of said eyelet means after same has traversed said capture path, said capture area being at least several times larger than said metal predetermined diameter to permit up to 90 degrees of movement of said eyelet means relative the associated attachment means in at least two planes intersecting where such eyelet means and attachment means connect and, said hook further defining a restriction point between said modular element annular member bottom edge and said straight member adjacent where said straight member joins said curved area, said restriction point being just slightly wider than said metal predetermined diameter to generally retain an eyelet means received within said capture area while permitting said eyelet means to be removed therefrom by careful guidance past said restriction point continuing outward along said capture path till reaching said entrance thereof, for detaching adjacent modular elements without requiring bending of said eyelet means or said attachment means.

10. Modular jewelry apparatus as in claim 9, wherein:

said retaining means includes one of an oval and round structure of metal providing a central opening which receives said stones with an interference fit.

11. Modular jewelry apparatus as in claim 9, further including auxiliary attachment means for permitting said modular jewelry apparatus to be worn.

12. Modular jewelry apparatus as in claim 10, wherein:

said retaining means has stones received therein projecting outwardly from said top edge while being recessed relative said bottom edge.

13. Modular jewelry apparatus as in claim 11, comprising:

at least two of said modular elements, one of which includes an auxiliary attachment means comprising an earring post piece with mating clasp; and said apparatus further including a modular end element, having a retaining means for securing jewel stones, and having an eyelet means for removably connecting to a hook associated with the other of said at least two modular elements, said modular end element defining a drop piece adapted for use with said modular jewelry apparatus when same is configured to be worn as earrings.

14. Modular jewelry as in claim 9, wherein said jewelry is adapted to be worn as earrings, with one of said modular elements including an earring post piece with mating clasp as said eyelet means thereof, and said modular jewelry further includes a modular end piece, having an eyelet means but no hook means, to serve as a drop piece with such earrings.

15. Modular jewelry as in claim 9, wherein said jewelry is adapted to be worn on clothing as a pendant, with one of said modular elements including a hinged pin clasp as said eyelet means thereof, for fastening such member and other modular elements associated therewith to the clothing of a user.

16. Modular jewelry as in claim 9, wherein said jewelry is adapted to be worn configured as one of a bracelet, necklace, and belt, with said plurality of modular elements being operatively associated in a continuous chain, the either ends of such chain being associated with a pair of bracelet, necklace, or belt end pieces, each of such pair having only said attachment means or said eyelet means for appropriate operative association with corresponding mates thereto on said ends of said chain.

* * * * *